US005220542A

United States Patent [19]

Zink et al.

[11] Patent Number: 5,220,542

[45] Date of Patent: Jun. 15, 1993

[54] ANTI-ROTATIONAL DEVICE FOR A CAM-OPERATED TIMER

[75] Inventors: David E. Zink; Daniel K. Amonett, both of Indianapolis, Ind.

[73] Assignee: Emerson Electric Co., St. Louis, Mo.

[21] Appl. No.: 836,698

[22] Filed: Feb. 18, 1992

[51] Int. Cl.[5] ..... B04F 8/00; H01H 43/00; H01H 43/12

[52] U.S. Cl. ..... 368/107; 200/38 R; 200/38 A; 200/38 B

[58] Field of Search ..... 368/10, 107-113; 200/31 R, 31 A, 35 R, 38 R, 38 A, 38 B, 38 BA, 38 C, 38 FA, 38 FB

[56] References Cited

U.S. PATENT DOCUMENTS 3,735,062 5/1973 Chestnut et al. ..... 200/38 R
4,346,271 8/1982 Cushing ..... 200/38 R
4,348,560 9/1982 Ray et al. ..... 200/38 A
4,889,964 12/1989 Pea et al. ..... 200/31 R
4,983,790 1/1991 Bogda et al. ..... 200/30 R

*Primary Examiner*—Vit W. Miska
*Attorney, Agent, or Firm*—Robert F. Meyer; Eric Waldkoetter

[57] ABSTRACT

An anti-rotational device for a cam-operated timer is used in appliances with timer control knobs that recess when the appliance is operating. A spring biased axially displaceable shaft that carries a circular disc having teeth peripherally disposed around its circumference is provided. When the shaft is axially displaced by pressure on the timer control knob, the teeth on the circular disc engage raised tabs on the timer's housing, and the engagement prevents the shaft from rotating.

3 Claims, 2 Drawing Sheets

ANTI-ROTATIONAL DEVICE FOR A CAM-OPERATED TIMER

BACKGROUND OF THE INVENTION

This invention relates to electromechanical timers used in controlling appliance functions where a selection of timer functions can be made by manually rotating a control knob on the timer.

Electromechanical timers are widely used to control functions in automatic appliances. Such timers use a control knob to select various functions desired to be performed by the appliance.

Generally the control knob is fixed on a shaft that provides the rotational axis for a rotating cam.

In prior art timers, a declutch mechanism is used in conjunction with a line switch to prevent a camstack from being manually advanced by the control knob while power is applied to the timer. This invention prevents the timer control knob from being manually rotated when pressure is applied by an appliance operator to the end of the control knob. Rapid rotation of the control knob while the timer is functioning can cause damage to electrical contacts on the timer's switch means, and damage to the appliance by abrupt function changes.

SUMMARY OF THE INVENTION

Accordingly a mechanism is provided that prevents manual control knob rotation when pressure is applied to the control knob. In general, the timing mechanism comprises a housing, a drive means, a shaft means, that is spring biased and axially displaceable a cam means carried by the shaft means with the cam means coupled to the drive means for rotation, a switch means responsive to the cam means, and a stop means comprising a circular disc integral to said shaft means having peripherally disposed teeth around its circumference that selectively engage tabs carried on said housing to prevent rotation of said shaft means.

DETAILED DESCRIPTION OF THE INVENTION

Figure 1:
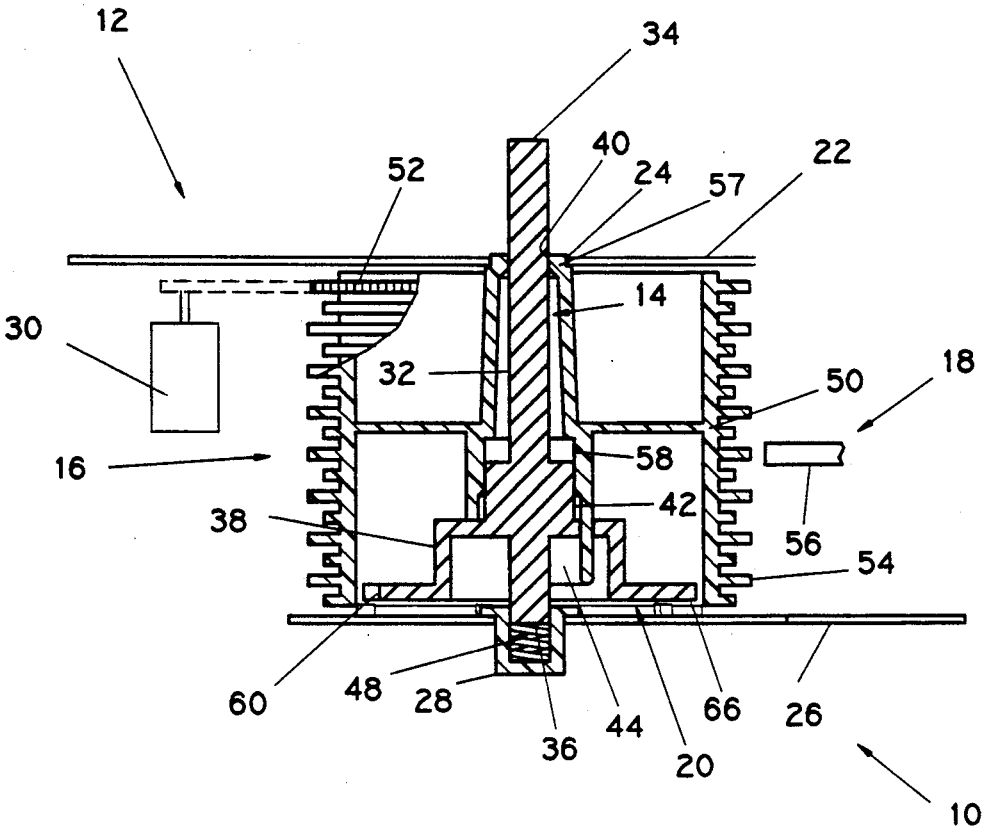
FIG. 1 is a cut-away view of the side of a timer employing the features of the invention in one operating position.
Figure 3:
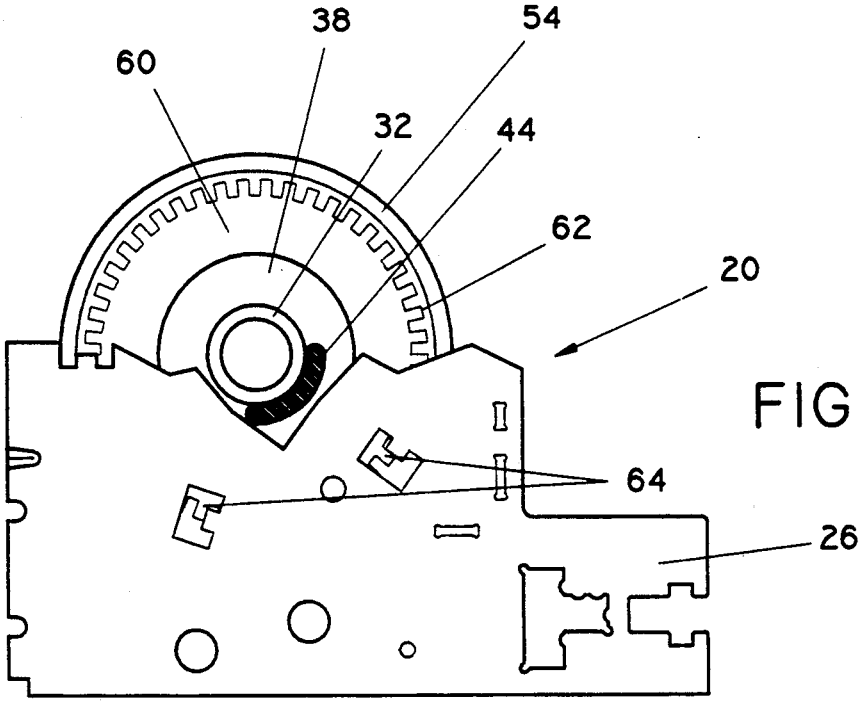
FIG. 3 is a bottom view of the timer with a portion of the housing cut-away to better illustrate the invention.
Figure 4:
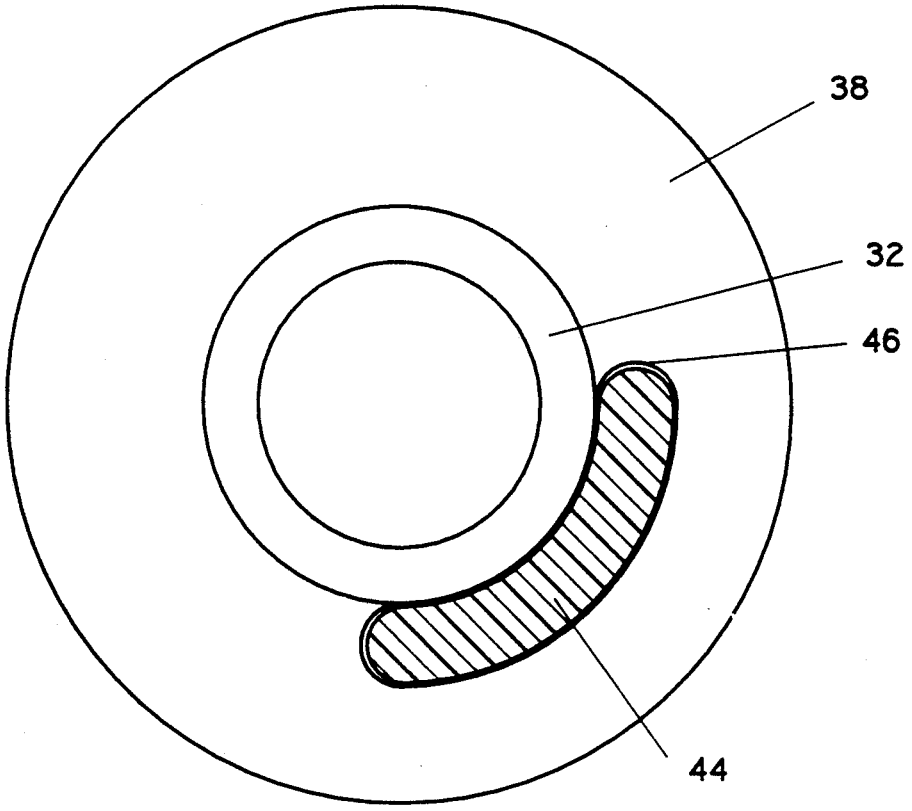
FIG. 4 is an enlargement of a bottom view of the timer to better illustrate the invention.

Referring to FIG. 1, there is shown a sectioned view of a cam-operated timer. The timer includes a housing 10, a drive means 12, a shaft means 14, a cam means 16 carried by the shaft means 14 coupled to the drive means 12 for rotation, a switch means 18 responsive to cam means 16, and a stop means 20 (FIG. 3) attached to the housing 10 and the shaft means 14. The housing 10 includes an upper plate 22, an opening 24 in the upper plate 22 providing an upper bearing for rotation of the cam means 16, a lower plate 26, and a cup-shaped busing 28 in the lower plate 26 that serves as a lower bushing for rotation of the shaft means 14. The housing lower plate 26 also serves as a point of attachment for the stop means 20 (FIG. 3). The drive means 12 includes a motor 30 coupled to a gear 52 on the cam means 16 in a manner well known in the art.

The shaft means 14 includes a shaft 32 having a control end 34 which is manually rotated to select appliance functions, a base end 36, and a flange 38. The shaft 32 extends through the cam means 16, and the cam hub 57 provides an upper bearing 40 for the shaft 32. The lower bearing for the shaft 32 is provided by the cup-shaped bushing 28 in the housing lower plate 26. An enlarged portion of the shaft 32 provides a lower bearing 42 for the cam means 16. The shaft 32 is coupled to the cam means 16 by a tang 44 extending from the bottom of the lower bearing 58 of the cam means 16 that engages a semi-circular slot 46 (FIG) 4 in the flange 38 of the shaft 32. The shaft base end 36 is carried within the cup-shaped bushing 28 which provides a journal for rotation. A spring 48 placed between the shaft base end 36 and inside the cup-shaped bushing 28 biases the shaft 32 away from the bottom of the cup-shaped bushing 26.

The cam means 16 includes a camstack 50 having a gear 52, a plurality of cam profiles 54, a hub 57, a lower bearing 58, and a tang 44. The cam hub 57 extends through an opening 24 in the housing upper plate 22 providing an upper bearing for rotation of the camstack 50. The camstack gear 52 is coupled to the motor 30 in a manner well known in the art. The switch means 18 includes a plurality of switches 56, only one shown, that engage a plurality of cam profiles 54 to be opened and closed.

The stop means 20 (FIG. 3) includes a circular disc 60, teeth 62, and tabs 64 attached to the housing lower plate 26. The circular disc 60 is integral to the shaft 32. The teeth 62 are carried on the periphery of the circular disc 60. The tabs 64 are attached to the housing lower plate 26, and protrude up toward the teeth 62 on the circular disc 60.

The operation of the device can now be shown. In FIG. 1 when the shaft control end 34 does not have pressure applied by an appliance operator, the shaft 32 is biased by the spring 48 away from the bottom of the cup-shaped bushing 28. When the shaft 32 is in the biased position there is clearance 66 between the teeth 62 on the circular disc 60 and the tabs 64 on the housing lower plate 26. The clearance 66 allows the shaft control end 34 to be rotated for appliance function selection.

Figure 2:
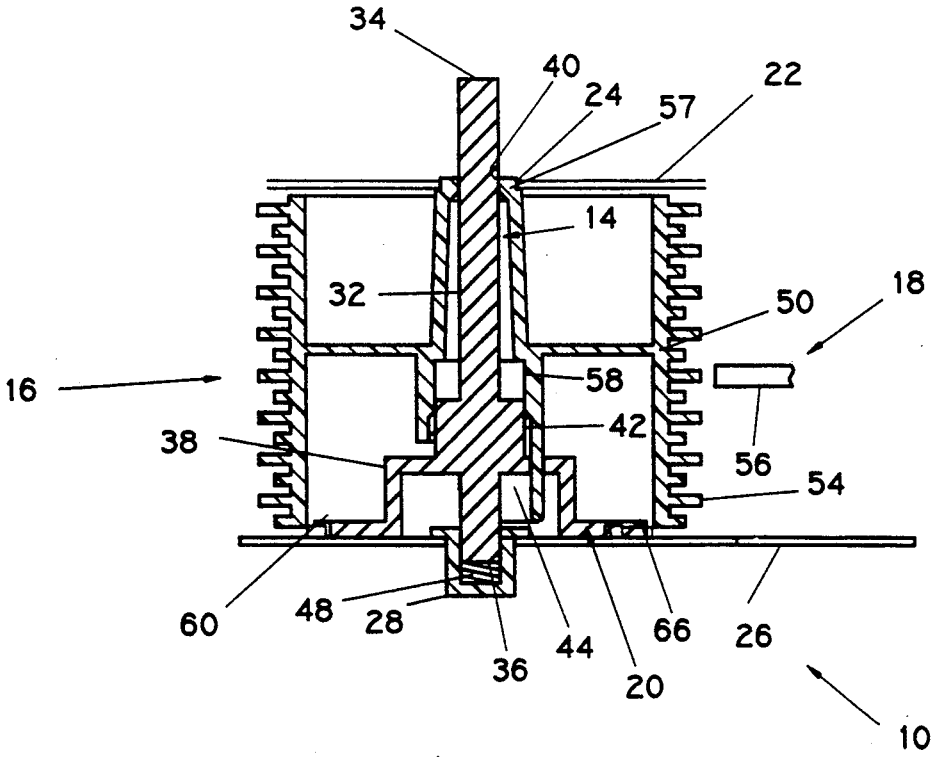
FIG. 2 is also a cut-away view of the side of the timer employing the features of the invention in another operating position.

Now referring to FIG. 2, when an appliance operator applies pressure to the shaft control end 34, the shaft 32 displaces axially deeper into the cup-shaped bushing 28 compressing the spring 48. The shaft 32 to camstack 50 coupling allows the shaft 32 to axially displace while the camstack 50 remains stationary. The axial movement of the shaft 32 eliminates the clearance 66 between the teeth 62 on the circular disc 60 and the tabs 64 on the housing lower plate 26 causing the tabs 64 mesh with the teeth 62. Because the tabs 64 are attached to the housing lower plate 26 that remains stationary, when the teeth 62 mesh with the tabs 64, the circular disc 60 is also held stationary The circular disc 60 is integral to the shaft 32, so the shaft 32 is held stationary.

Because the shaft 32 is coupled to the camstack 50 by a tang 44 and semi-circular slot 46 connection, the camstack 50 cannot rotate as long as pressure is applied to the shaft control end 34. Once pressure on the shaft control end 34 is released, the spring 48 returns the shaft 32 to the biased position away from the bottom of the cup-shaped bushing 28. The clearance 66 between the teeth 62 on the circular disc 60 and the tabs 64 on housing lower plate 26 is restored, and the shaft 32 and camstack 50 can once again be manually rotated to select an appliance function.

What is claimed is:

1. A timing mechanism comprising:

(a) a housing, (b) a drive means, (c) shaft means that is spring biased and axially displaceable, (d) a cam means carried by said shaft means and coupled to said drive means for rotation, (e) a switch means responsive to said cam means, and (f) a stop means comprising a circular disc integral to said shaft means having peripherally disposed teeth around its circumference that selectively engage tabs carried on said housing to prevent rotation of said shaft means.

2. In a timing mechanism according to claim 1, wherein when pressure is applied to a control end of said shaft means, said shaft means axially displaces and said circular disc peripherally disposed teeth engage said tabs to prevent rotation of said shaft means.

3. In a timing mechanism according to claim 1, wherein when pressure is released from a control end of said shaft means, said shaft means returns to a spring biased position and said stop means permits rotation of said shaft means.

* * * * *